US009361768B2

(12) United States Patent
Pereira et al.

(10) Patent No.: US 9,361,768 B2
(45) Date of Patent: Jun. 7, 2016

(54) INFORMATION GAUGE WITH ANALOG BACKUP

(71) Applicant: Western/The Scott Fetzer Company, Westlake, OH (US)

(72) Inventors: Ryan Pereira, Westlake, OH (US); Gregory Eytchison, Huron, OH (US); Bryan Eyring, Lakewood, OH (US); Joseph Frank Brager, Painesville, OH (US); Marius Milea, Westlake, OH (US)

(73) Assignee: Western/Scott Fetzer Company, Westlake, OH (US)

( * ) Notice: Subject to any disclaimer, the term of this patent is extended or adjusted under 35 U.S.C. 154(b) by 0 days.

(21) Appl. No.: 14/460,828

(22) Filed: Aug. 15, 2014

(65) Prior Publication Data

US 2015/0048955 A1 Feb. 19, 2015

Related U.S. Application Data

(60) Provisional application No. 61/866,091, filed on Aug. 15, 2013.

(51) Int. Cl.

| | |
|---|---|
| ***G08B 21/00*** | (2006.01) |
| ***G08B 5/22*** | (2006.01) |
| ***G08B 5/06*** | (2006.01) |

(52) U.S. Cl.

CPC ... *G08B 5/22* (2013.01); *G08B 5/06* (2013.01)

(58) Field of Classification Search

CPC ..... G08B 5/00
USPC ..... 340/815.69, 626, 540; 73/1.57, 700, 73/749

See application file for complete search history.

(56) References Cited

U.S. PATENT DOCUMENTS 4,404,842 A 9/1983 Mooney
6,822,565 B2 11/2004 Thomas et al.

(Continued)

FOREIGN PATENT DOCUMENTS

EP 2339222 6/2011

OTHER PUBLICATIONS

International Search Report dated Dec. 17, 2014 and Written Opinion of the International Searching Authority dated Dec. 17, 2014 for PCT International Application No. PCT/US2014/051282, filed Aug. 15, 2014, PCT International Application No, PCT/US2014/051282 corresponds to and claims priority from U.S. Appl. No. 61/866,091, filed Aug. 15, 2013. (10 pages)

(Continued)

*Primary Examiner* — Jeffrey Hofsass
(74) *Attorney, Agent, or Firm* — Tarolli, Sundheim, Covell & Tummino LLP

(57) ABSTRACT

An information gauge apparatus and method for providing both visual and audio readings of pressure within a pressure vessel. The information gauge apparatus includes a digital display coupled to a printed circuit board in communication with a pressure sensor. The digital display illustrates indicia relating gas pressure levels provided by the pressure sensor to the printed circuit board during use. The gauge further comprises an audible indicator coupled to the printed circuit board, the audible indicator provides an audible signal relating to gas pressure levels sensed by the pressure sensor to the printed circuit board during use. The gauge also includes a mechanical sensor providing a mechanically sensed reading value to a visual indicia display on the information gauge apparatus relating to gas pressure levels during use.

22 Claims, 13 Drawing Sheets

(56) References Cited

U.S. PATENT DOCUMENTS

| | | | |
|---|---|---|---|
| 7,891,250 | B2 | 2/2011 | Parias |
| 8,047,079 | B2 | 11/2011 | Bleys et al. |
| 8,400,288 | B2 | 3/2013 | Bowden et al. |
| 2006/0144159 | A1 | 7/2006 | Weiss |
| 2010/0024517 | A1 | 2/2010 | Ratner |

OTHER PUBLICATIONS 2 page Liquid Air Advertisement that was on sale more than one year prior to the filing date of this application, namely Aug. 14, 2012.

INFORMATION GAUGE WITH ANALOG BACKUP

CROSS REFERENCES TO RELATED APPLICATIONS

The following application claims priority to U.S. Provisional Patent Application Ser. No. 61/866,091 filed Aug. 15, 2013 entitled INFORMATION GAUGE WITH ANALOG BACKUP. The above-identified application is incorporated herein by reference in its entirety for all purposes.

TECHNICAL FIELD

The present disclosure relates generally to an information gauge apparatus and method of operation, and more specifically, an information gauge having an analog or mechanical backup to enhance its reliability during use.

BACKGROUND

Information gauges are incorporated into devices such as medical gas regulators, industrial gas regulators, valve integrated pressure regulators, manifolds and other assemblies utilizing a regulator for the delivery of gas or fluids (collectively hereinafter "regulators"). Conventional information gauges allow users of regulators often coupled to a pressurized container, such as pressurized cylinders to observe the amount of pressure gas that remains within the container. Such information is essential for patients and the medical professionals using the containers for medical treatment of the patients.

Medical professionals in their concern that a patient may run out of gas or oxygen often results in a return of pressurized cylinders still having ample unused oxygen. Pressurized container industry veterans typically observe about 30% of the medical oxygen cylinders being returned with a significant amount of usable gas or product.

SUMMARY

One example embodiment of the present disclosure includes an information gauge apparatus and method for providing both visual and audio readings of pressure within a pressure vessel with mechanical redundancy. The information gauge apparatus includes a digital display coupled to a printed circuit board in communication with a pressure sensor. The digital display illustrates indicia relating gas pressure levels provided by the pressure sensor to the printed circuit board during use. The gauge further comprises an audible indicator coupled to the printed circuit board, the audible indicator provides an audible signal relating to gas pressure levels sensed by the pressure sensor to the printed circuit board during use. The gauge also includes a mechanical sensor providing a mechanically sensed reading value to a visual indicia display on the information gauge apparatus relating to gas pressure levels during use.

Another example embodiment of the present disclosure includes an information gauge apparatus for displaying information relating to diagnostics when the information gauge apparatus is coupled to a pressure vessel, the apparatus comprises: a digital gauge having a digital display, printed circuit board, and pressure sensor, the digital display being coupled to and in communication with the printed circuit board that is further coupled to and in communication with the pressure sensor, the digital display illustrating pressure conditions relating a pressure vessel when in use; a mechanical gauge providing a mechanically sensed pressure conditions relating to a pressure vessel when in use; a casing for supporting the mechanical gauge and the digital gauge having a back plate and a front plate; and an input duct for coupling the digital gauge and the mechanical gauge to a pressure vessel during use, the input duct having a single orifice for coupling to a pressure vessel, the single orifice having a pathway that is divided between a first fluid communication channel for coupling to the mechanical gauge and a second fluid communication channel for coupling to the digital gauge.

While another example embodiment of the present disclosure includes an information gauge apparatus for providing both visual and audio readings of pressure within a pressure vessel, the information gauge apparatus comprising: a digital display coupled to a printed circuit board in communication with a pressure sensor, the digital display illustrating indicia relating gas pressure levels provided by the pressure sensor to the printed circuit board during use; an audible indicator coupled to the printed circuit board, the audible indicator providing an audible signal relating to gas pressure levels provided by the pressure sensor to the printed circuit board during use; and a mechanical sensor providing a mechanically sensed reading value to a visual indicia display on the information gauge apparatus relating to gas pressure levels during use.

Yet another example embodiment of the present disclosure comprises a digital audio visual information gauge with a mechanical pressure indicating backup, the gauge comprising: a casing that provides a housing for a mechanical system and an electrical system, the electrical system is capable of indicating time and pressure remaining in a cylinder valve assembly during use and the mechanical system being capable of indicate pressure remaining in the same cylinder valve during use; an input duct that is rigidly connected to the casing, the input duct having a single orifice for connecting to a cylinder valve at a first end of the input duct and first and second fluid communication channels at a second end of the input duct, the first and second fluid communication channels being in communication with the single orifice, the first fluid communication channel for coupling to the mechanical system and the second communication channel for coupling to the electrical system.

BRIEF DESCRIPTION OF THE DRAWINGS

The foregoing and other features and advantages of the present disclosure will become apparent to one skilled in the art to which the present disclosure relates upon consideration of the following description of the invention with reference to the accompanying drawings, wherein like reference numerals, unless otherwise described refer to like parts throughout the drawings and in which.

DETAILED DESCRIPTION

Referring now to the figures wherein like numbered features shown therein refer to like elements throughout unless otherwise noted. The present disclosure relates generally to an information gauge apparatus and method of operation, and more specifically, an information gauge apparatus having an analog or mechanical backup to enhance its reliability during use.

Figure 1:
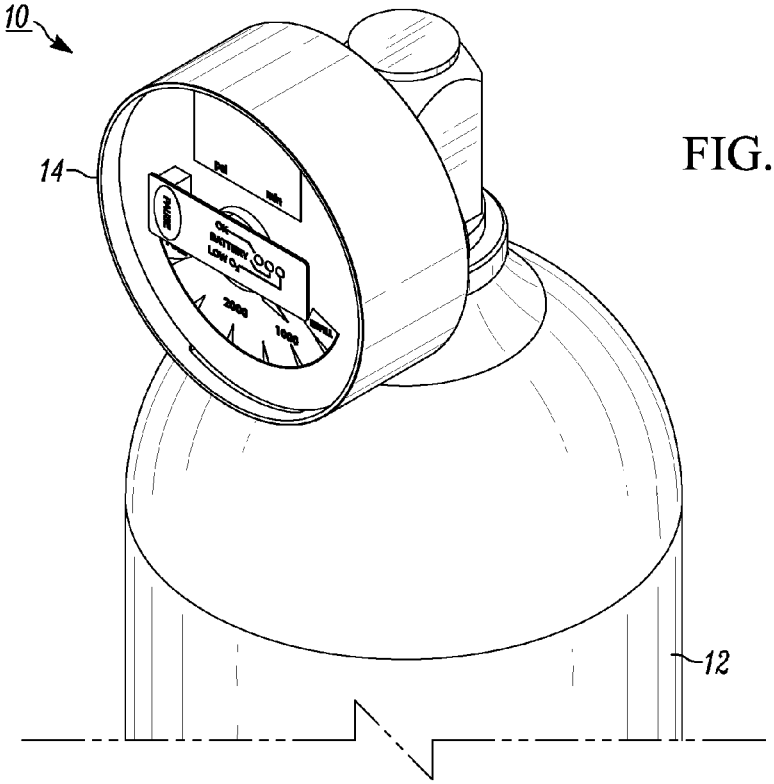
FIG. 1 is a perspective view of a pressure assembly having an information gauge apparatus and pressure vessel constructed in accordance with one example embodiment of the present disclosure.
Figure 2:
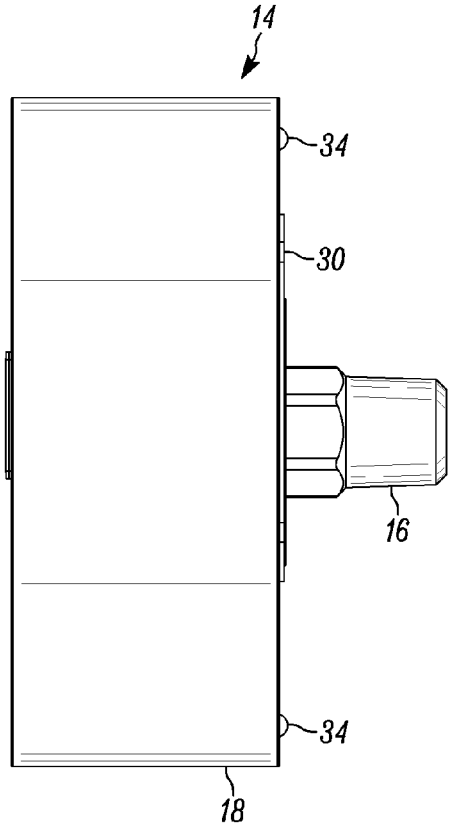
FIG. 2 is a side elevation view of an information gauge apparatus constructed in accordance with one example embodiment of the present disclosure.
Figure 3:
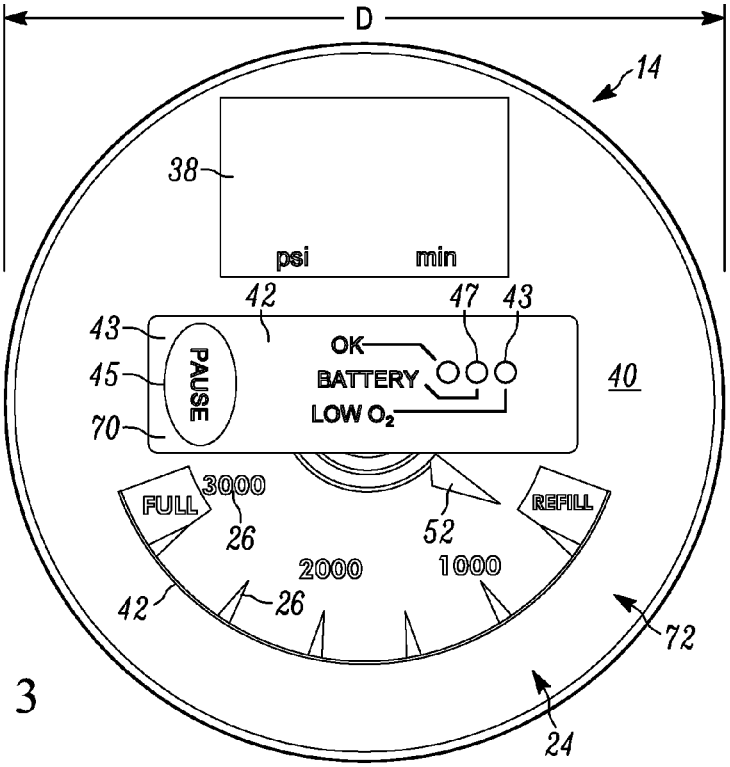
FIG. 3 is a front elevation view of FIG. 2.
Figure 4:
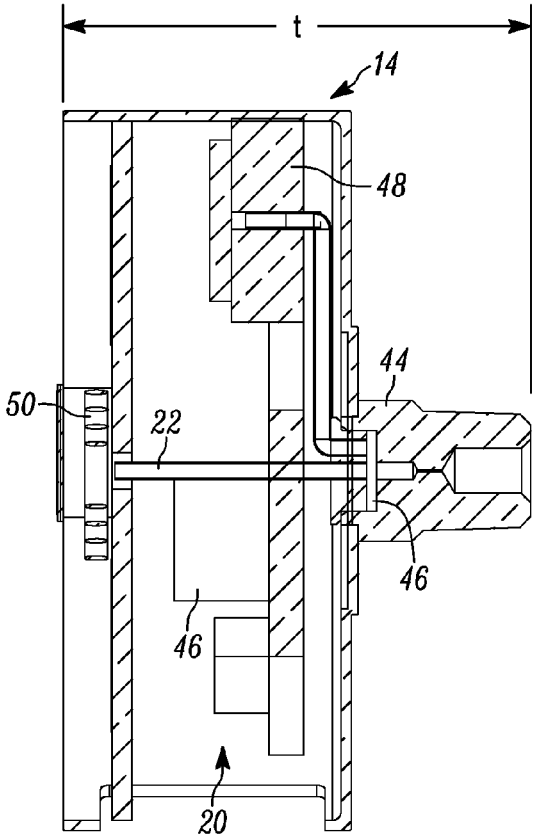
FIG. 4 is a section view of FIG. 3 along section lines A-A.

Referring again to the figures and in particular to FIG. 1 is a perspective view of a pressure assembly 10 comprising a pressurized container or cylinder 12 in fluid communication with an information gauge apparatus 14. The information gauge apparatus 14 includes an input duct 16 (see FIG. 2), such as one provided by a fitting that is rigidly connected to a housing or case 18. The rigid connection between the case and the input duct is possible through fasteners, insert molding, or other approaches appreciated by those of ordinary skill in the art. The gauge housing 18 encases the all of the digital and mechanical components 20 forming a mechanical system 21 of the gauge 14 and provides a rigid connection via a groove 22 to a gauge face 24, as illustrated in FIGS. 3 and 4. Indicia 26 on the gauge face 24 illustrate the various pressure reading of the cylinder or vessel 12. In one example embodiment, the indicia are painted onto the gauge face with florescent and/or luminescent paint.

The housing 18 includes a removable member 30 on its rear opposite a side of the gauge face or plastic lens 24. The removable member 30 is removably yet rigidly connected to the housing 18 to service an auxiliary power supply 32 to the gauge 14. In one example embodiment, the auxiliary power supply 32 includes conventional batteries. An example of such a rigid connection of the removable member 30 is through the use of fasteners 34, such as screws that engage the housing 18 or through the use of mechanical built in clips on the case or the removable member.

Figure 5:
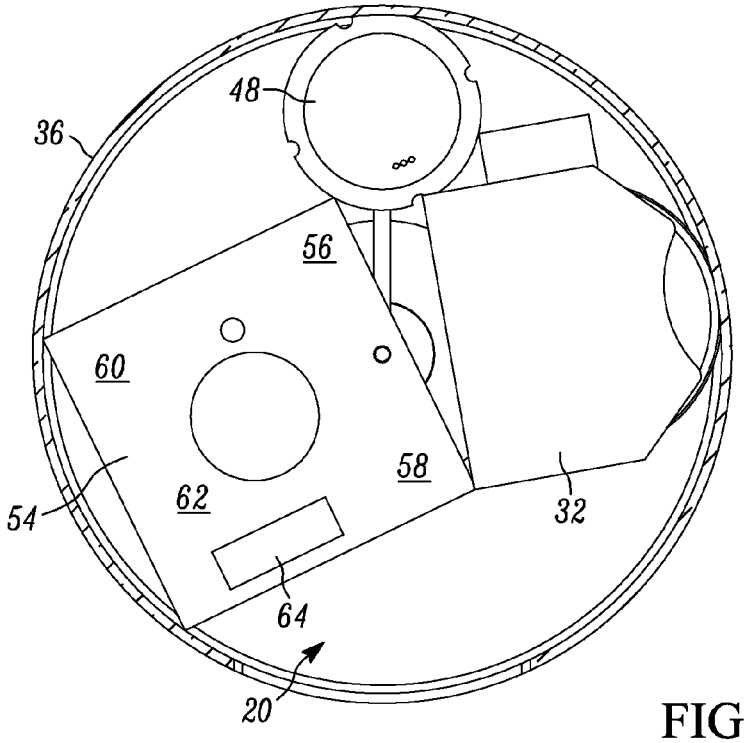
FIG. 5 is a section view of FIG. 4 along section lines B-B, illustrating the location of a circuit board, pressure sensor, and auxiliary power supply.
Figure 6:
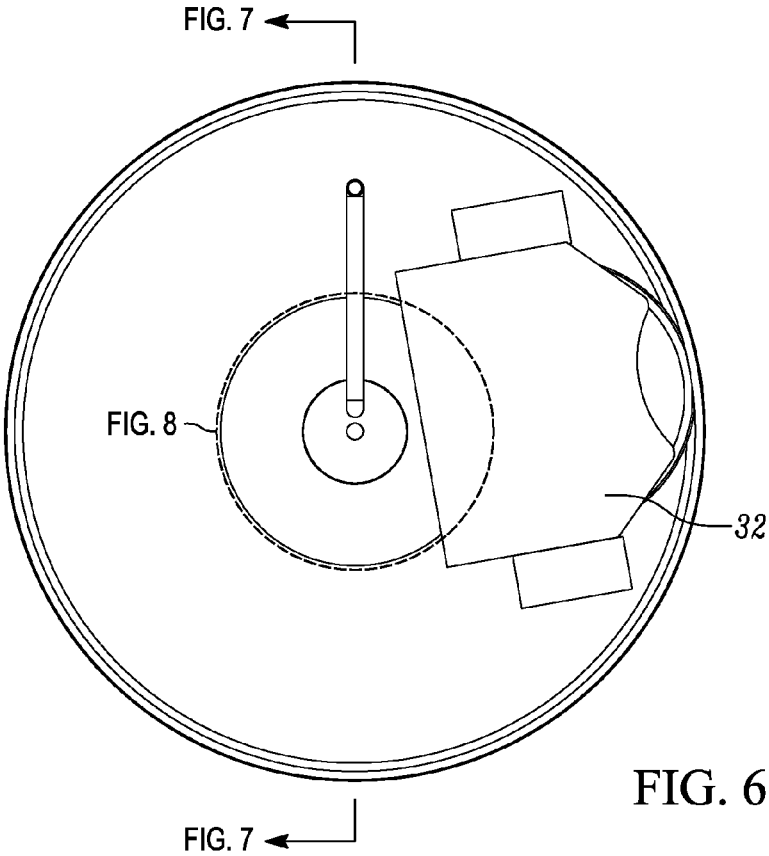
FIG. 6 is another section view of FIG. 4 along section lines B-B without the pressure sensor and circuit board illustrated in FIG. 5.
Figure 7:
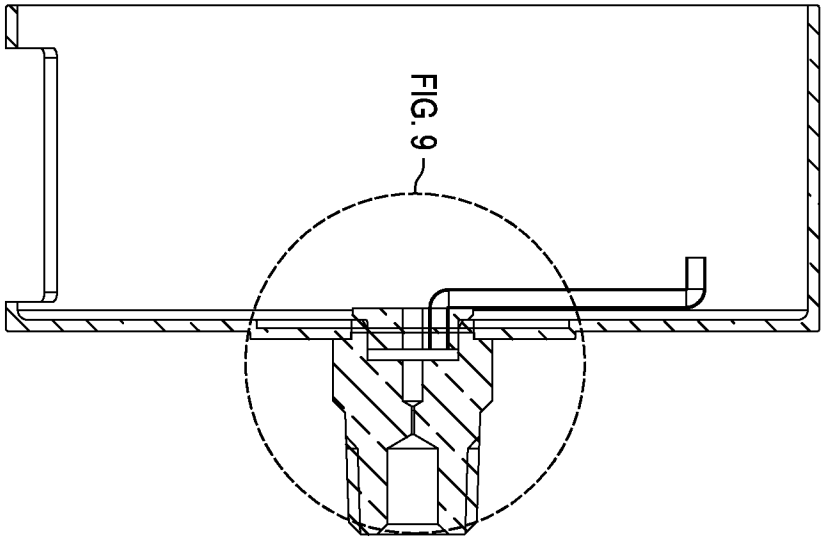
FIG. 7 is a section view of FIG. 6 along section lines B-B.
Figure 8:
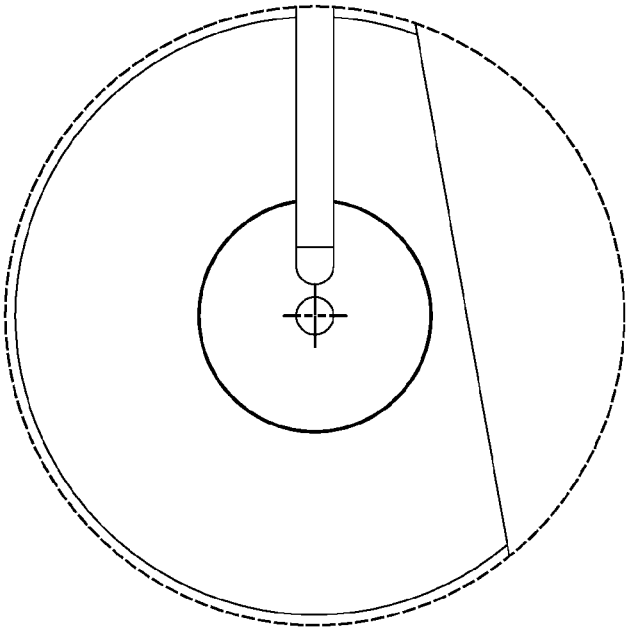
FIG. 8 is a magnified view of area A illustrated in FIG. 6.
Figure 9:
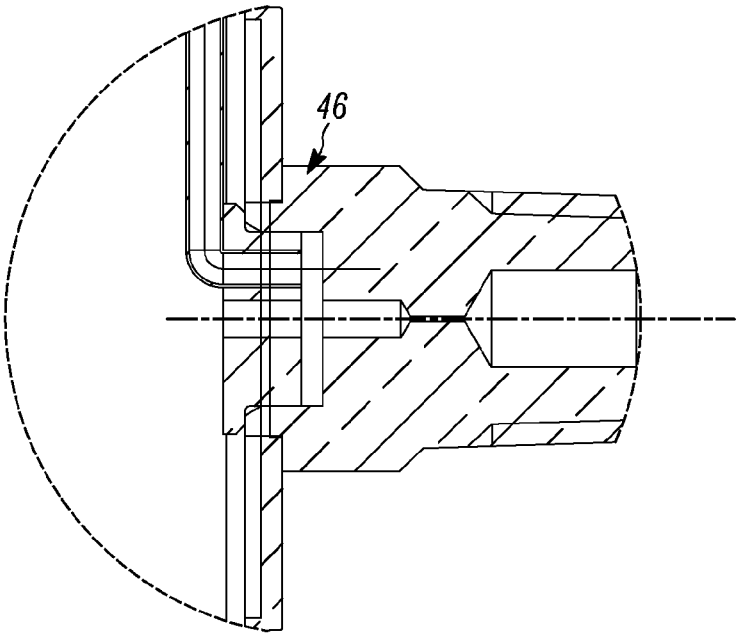
FIG. 9 is a magnified view of area C illustrated in FIG. 7.
Figure 10:
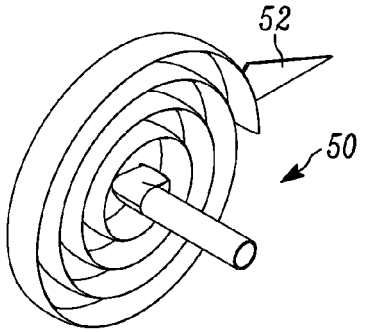
FIG. 10 is a perspective view of a mechanical backup constructed in accordance with one example embodiment of the present disclosure.
Figure 11:
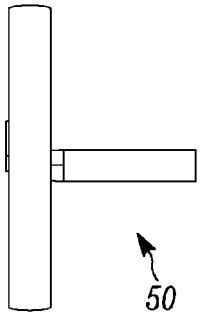
FIG. 11 is a side elevation view of FIG. 10.
Figure 12:
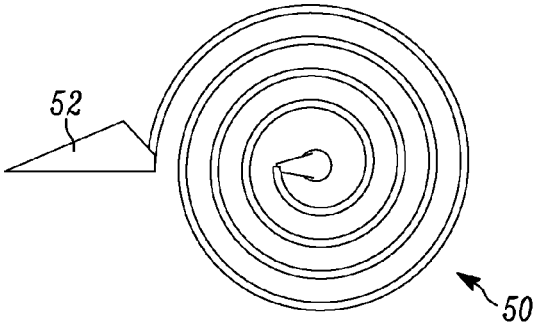
FIG. 12 is a front elevation of FIG. 10.
Figure 13:
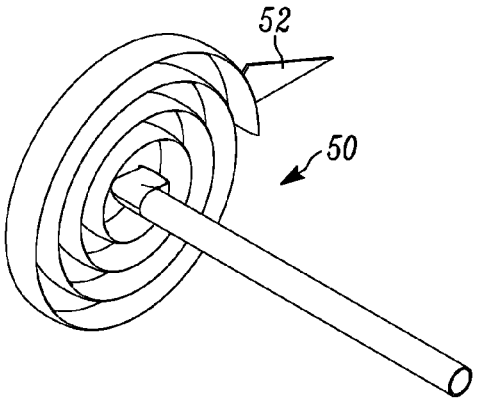
FIG. 13 is a perspective view of a mechanical backup constructed in accordance with one example embodiment of the present disclosure.
Figure 14:
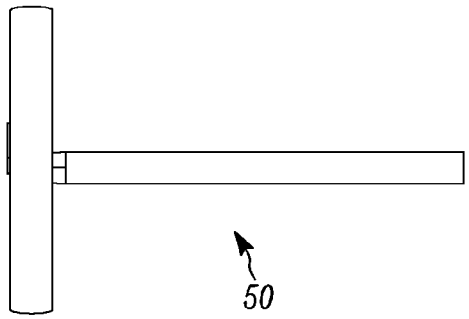
FIG. 14 is a side elevation view of FIG. 13.
Figure 15:
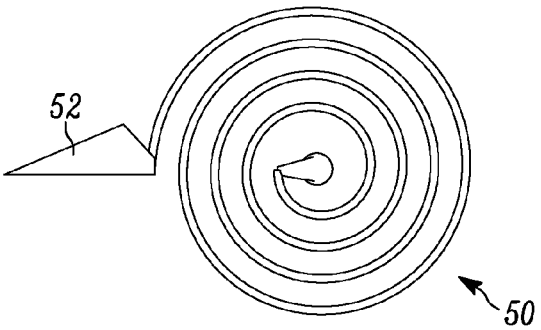
FIG. 15 is a front elevation of FIG. 13.

A face seal 36, such as an annular gasket or o-ring provides a water resistant environment relative to removable member 30, which is incorporated in the case 18 as illustrated in FIG. 5. In one example embodiment, the back plate of case 18 has a plurality openings 25 to allow the free movement of sound waves from a sound chip 27 coupled to a printed circuit board PCB 54 and to prevent over-pressurization in the event of a gas leak.

The case 18 further comprises an ingress resistant material resistant of dust and water. In one example embodiment, a suitable resistant material includes Gore-Tex. In another example embodiment, the gauge face 24 is made from a polymeric material and has mating features to rigidly locate an LCD screen 38 that is part of an electrical system 23. The case 18 in yet another example embodiment is made from a molded polymeric material such as plastic and includes an access panel 31 for the remove and installation of the power cells or batteries 32.

Figure 21:
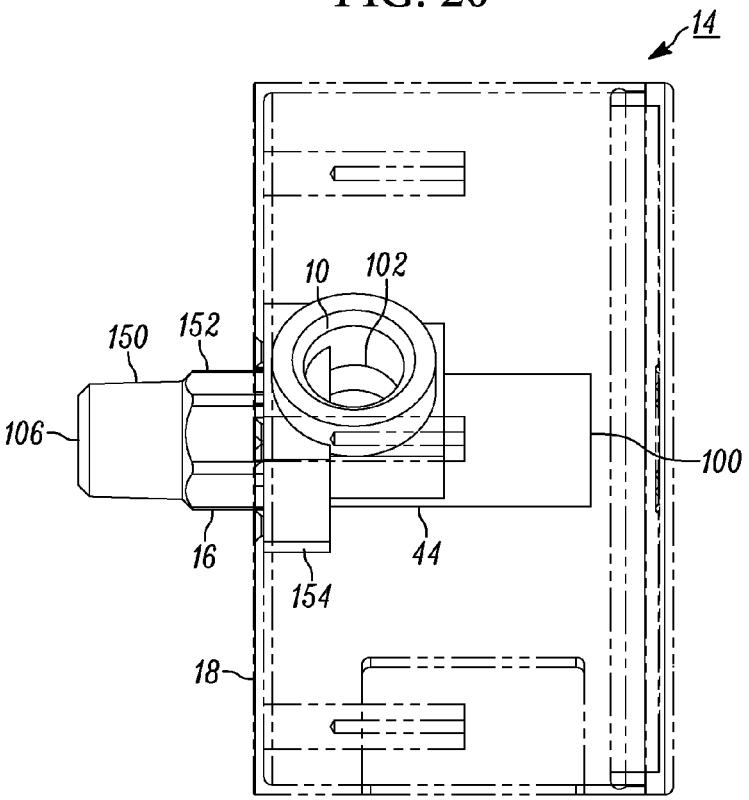
FIG. 21 is a third-side elevation assembly view of the pressure assembly of FIG. 16.
Figure 23:
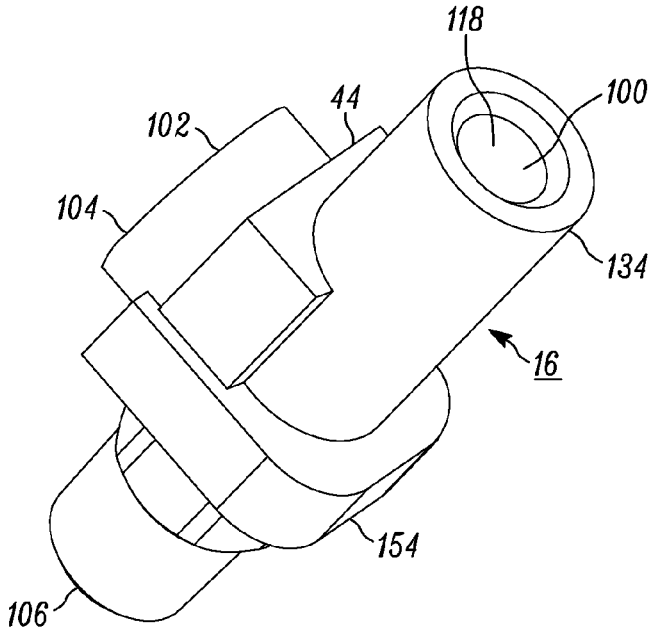
FIG. 23 is a perspective view of an input duct constructed in accordance with one example embodiment of the present disclosure.
Figure 24:
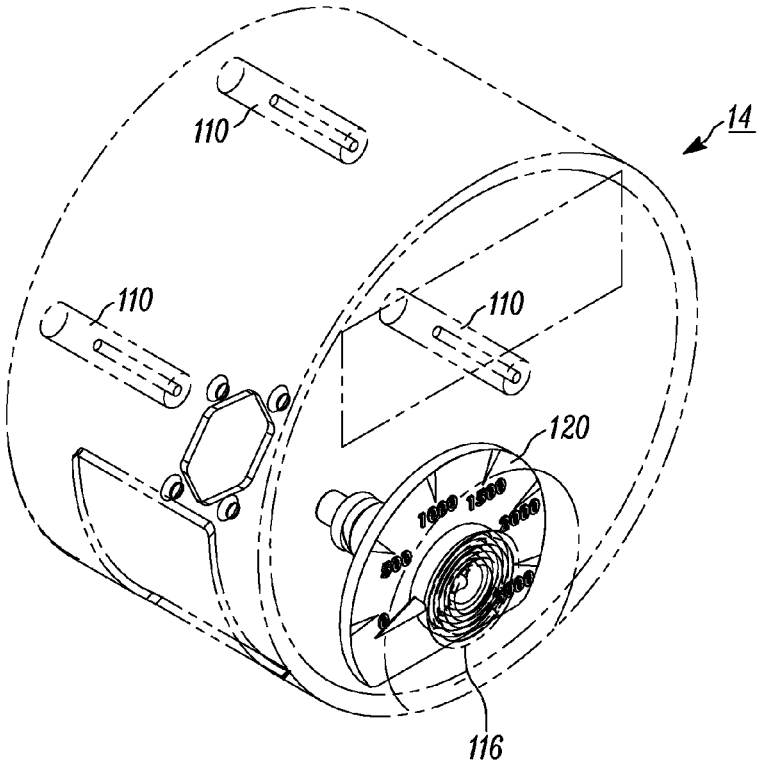
FIG. 24 is a perspective assembly view of a mechanical system as it is located in the gauge assembly in accordance with one example embodiment of the present disclosure.

The opposite side of the removable member 30 of the case 18 is rigidly connected to a transparent plastics lens 40 for viewing the LCD screen 38 and various visual indicators 42, such as battery indicators, oxygen level indicators, and pressure level indicators. The transparent plastic lens 40 may have opaque markings to hide the elements of the gauge 14 that do not provide information to the user for improved aesthetic appearance. The novel input duct 16 is advantageously located in the lower half of the case 18 to provide a direct fluid connection to both the digital system 23 and the mechanical or analog system 21. This enables the novel input duct 16 to be easily machinable and provide two fluid communication connections (a first fluid communication connection 100 and a second fluid communication connection 102) on a distal end 44 opposite a proximal or fluid input end 106, as illustrated in FIGS. 21 and 23. The distal end 44 (opposite the pressure vessel or cylinder 12) of the novel input duct 16 allows for fluid communication between the cylinder and the pressure sensor 48 of the digital system 23 and an analog gauge or direct drive gauge 116 of the mechanical system 21 that provide data to user of the gauge 14 relating to parameters (such as time, pressure, flow rate, and the like) of the pressure vessel 12.

Figure 17:
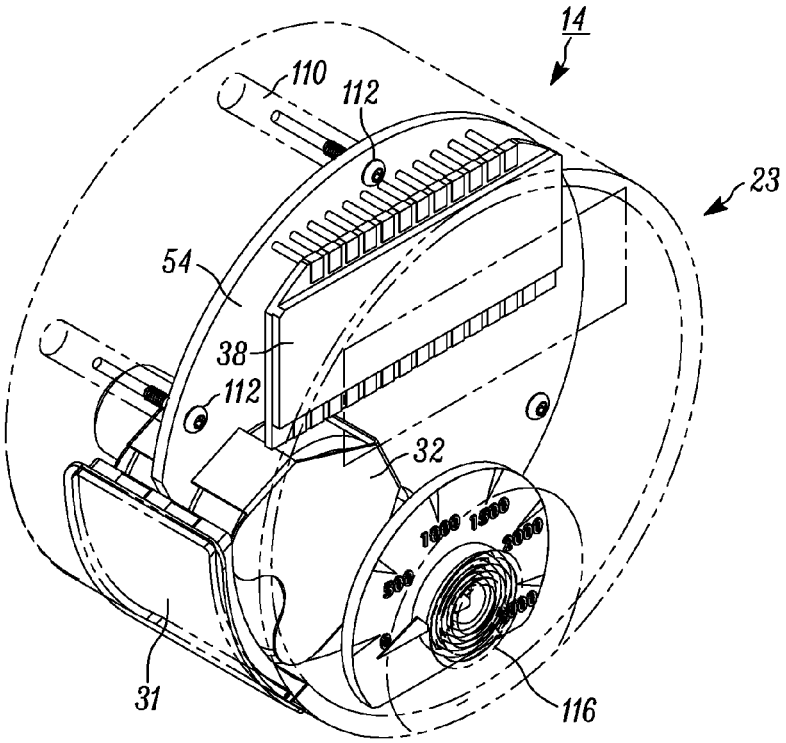
FIG. 17 is a perspective assembly view of the pressure assembly of FIG. 16.
Figure 18:
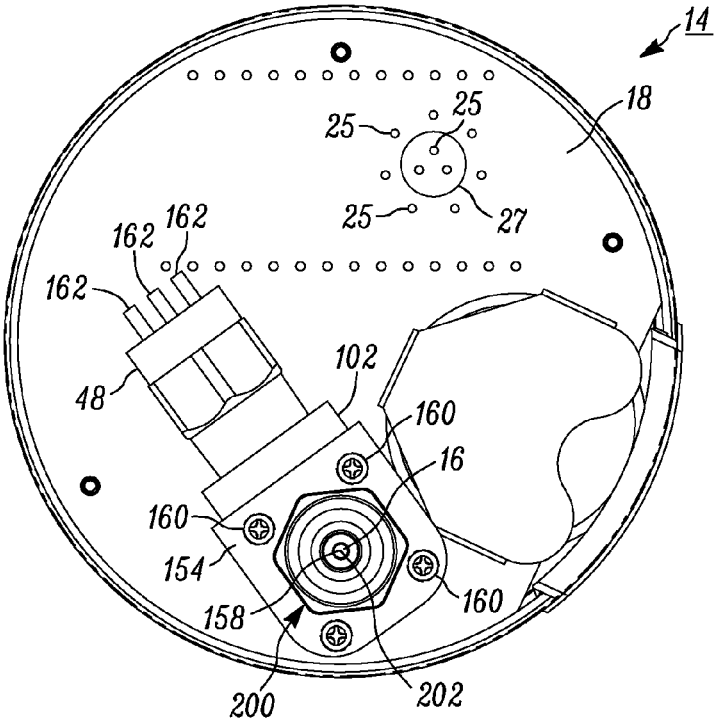
FIG. 18 is a rear elevation view of the pressure assembly of FIG. 16.
Figure 19:
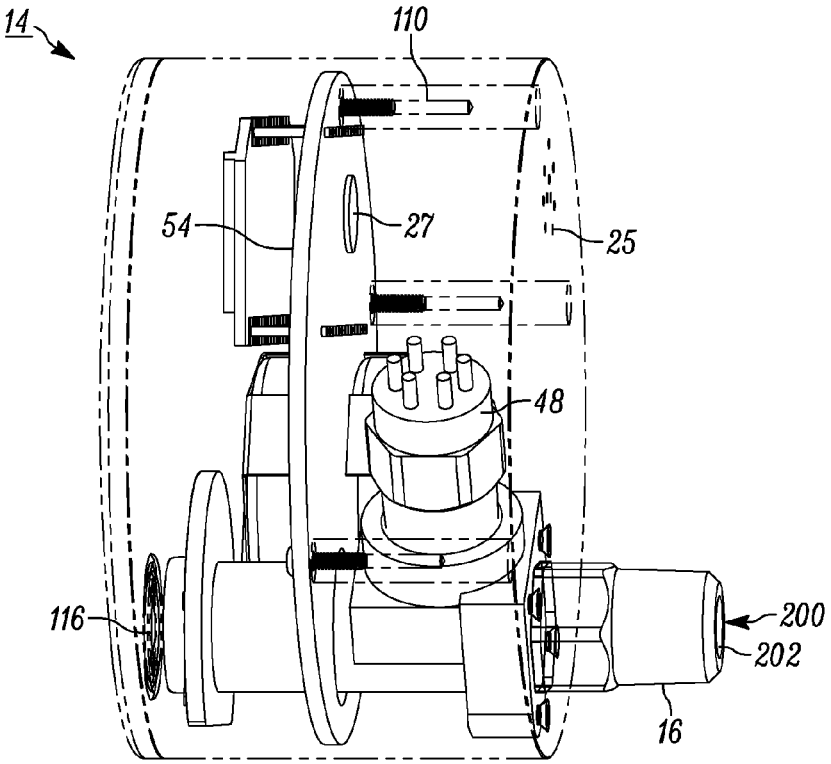
FIG. 19 is a first-side elevation assembly view of the pressure assembly of FIG. 16.
Figure 20:
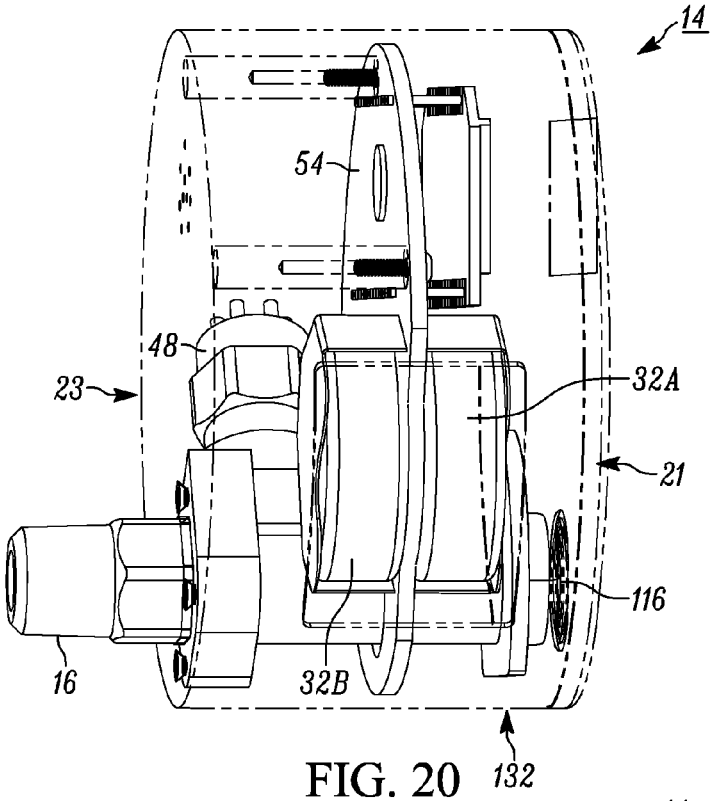
FIG. 20 is a second-side elevation assembly view of the pressure assembly of FIG. 16.
Figure 22:
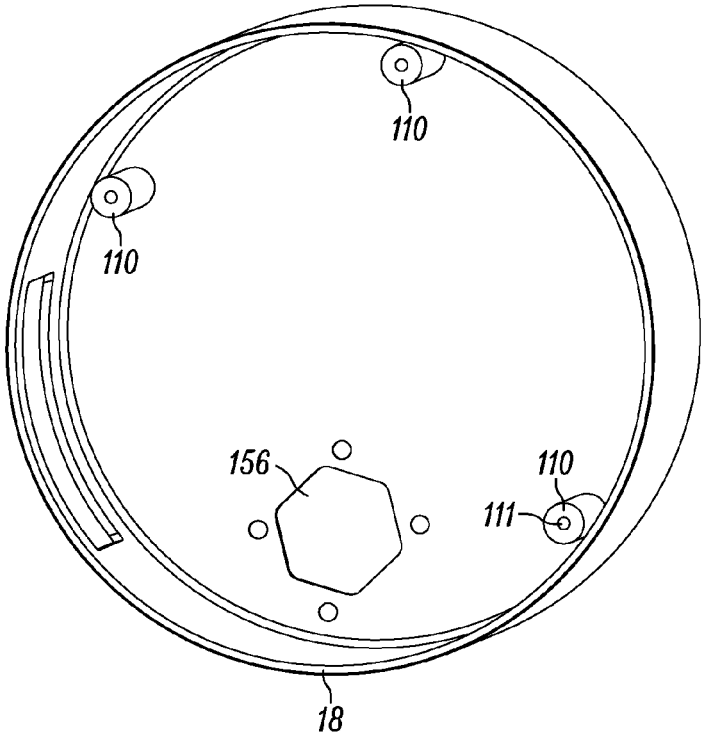
FIG. 22 is a elevation view of a housing constructed in accordance with one example embodiment of the present disclosure.

Illustrated in the example embodiment of FIG. 17, the digital system 23 is shown, comprising pressure sensor 48, printed circuit board (PCB) 54, LCD 38, power supply 32, microprocessor 56, input/output 58, oscillator 60, sound chip 27 or voice chip 52, and various other electronics all in electrical communication as would be appreciated by those of ordinary skill in the art. The PCB 54 in the illustrated example embodiment of FIGS. 17, 19, and 22 is supported by bosses 110 extending from and molded into the casing 18. The bosses 110 include tapped holes 111 for receiving fasteners 112 that only a portion pass through the PCB for securing the PCB into position within the casing 18.

The second fluid communication connection 102 of the input duct provides a pressure sensor 48 port 104 that can be orthogonal to the first fluid communication connection 100. The port 104 is a direct gauge port in order to provide a relatively small gauge diameter and thickness. In particular, the digital system 23 includes the pressure sensor 48 coupled and in communication with the printed circuit board 54, while the analog or mechanical system 21 includes a direct drive gauge 116 that is precalibrated and tested prior to installation into the first fluid communication connection 100 port 118.

In one example embodiment, the direct drive gauge 116 includes a built in feature on the face 120 that allows for install without screws due to the flat surface on the gauge face that enables rotation. This arrangement allows for the smallest possible overall size of the mechanical direct drive gauge 116. The direct drive gauge 116 is similar to most conventional mechanical gauges that can be purchased as a shelf item and would be a turn-key connection to the input duct 16.

In an alternative example embodiment, the mechanical system 23 comprises a bordon tube 50 that is connected to a needle 52. The needle 52 induces pressure on the gauge face 24 based on its markings, similar to a conventional mechanical gauge. The bordon tube 50 in the illustrated example embodiments of FIGS. 10-15 passes through a corresponding manifold tube 46 of the input duct 16.

Figure 25:
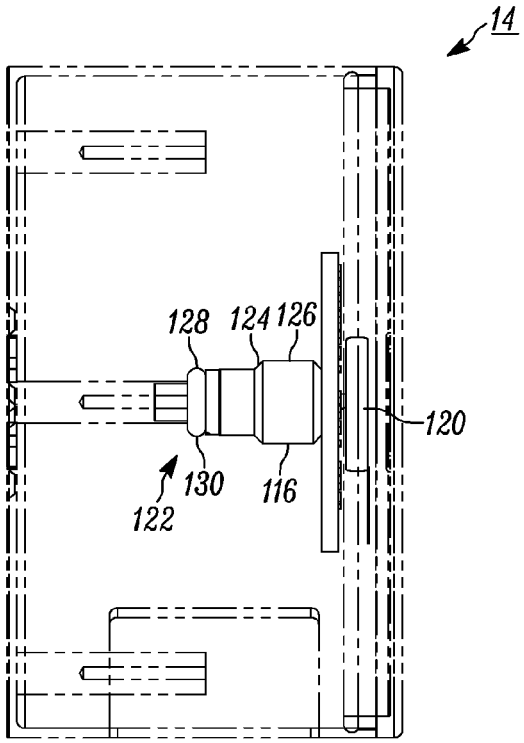
FIG. 25 is a side elevation view of FIG. 24.

Located at an end 122 opposite the analog gauge face 120 is a shaft body 124 (see FIG. 25) that rigidly connects to the input duct 16. The shaft body 124 includes a threaded portion 126, an o-ring 128, and backup ring 130 that mates with the input duct 16 to allow for a rigid connection 132 and provides a seal-tight engagement connection. A mating flat surface 134 shown on the input duct 16 in one example embodiment is coated with an adhesive, such as Loctite® to prevent rotation of the analog gauge 116.

The input duct 16 as can be seen in FIGS. 21 and 23 includes a threaded connecting end 150 for coupling to the cylinder 12. Surrounding the connecting end 150 is a plurality of wrench flats 152 for tightening the gauge information apparatus 14 to the cylinder 12. A flange 154 is located between the wrench flats 152 and shaft body 124. The flange 154 is constructed such that it is positioned within the casing 18, while the wrench flats 152 and threaded connected end project from an opening 156 found in the rear of the casing (see FIG. 22). The input duct 16 further comprises a single orifice 200 having a pathway 202 that is divided between a first fluid communication channel 100 for coupling to the mechanical gauge 21 and a second fluid communication channel 102 for coupling to the digital gauge 23.

The input duct 16 and more specifically the flange 154 includes a plurality of tapped holes 158 for the attachment of fasteners 160. The fasteners pass partially through the back of the casing 18 into the tapped holes 158 surrounding the flange 154. In one example embodiment, the input duct is made from metal, such as stainless steel or brass.

Referring again to the digital system 23, the pressure sensor 48 communicates with a PCB (Printed Circuit Board) assembly 54 that comprises a microprocessor 56, I/Os 58, oscillator 60, voice chip 62, and electronics 64, that include capacitors, resistors, transistors and other connectors. The electronic 64 connectors couple the PCB 54 to a battery pack 32 that provides power and to the LCD 38 (which is also coupled to the PCB) screen that displays information such as pressure, time remaining in minutes and the battery level. The pressure sensor 48 includes a number of contacts or terminals 162 that act as leads and are soldered or wired to the PCB 54 or to other portions of the digital system 23 as would be appreciated by one of ordinary skill in the art.

A full pressure (2016 psi) E size aluminum cylinder 12 has 679 liters and thus other values can be interpolated from this information. The microprocessor 56 obtains the differential pressure information from the pressure sensor 48 by sampling between 2 periods, which indicates the flow. For example, a loss of about 6 psi, in one minute equates to a flow of about 2 Liters per minute, which is computed by the microprocessor 56 and displayed in one example embodiment on the LCD screen 38. The microprocessor 56 also senses the overall pressure in the pressure vessel 12 through the pressure sensor 48, which is then by the microprocessor converted to total volume in liters.

During operation in one example embodiment, a full cylinder 12 could hold 679/liters, which is divided by 2 liters per minute by the microprocessor 56, which executes instructions in the form of non-transitory computer readable medium 57 that includes for example software, firmware, application specific analog circuit, or any combinations thereof hereinafter "recipe" that computes a result 59 that in this example is 339 minutes and 30 seconds of available time before the cylinder coupled to the gauge 14 becomes empty. One of the outputs 58 from the PCB assembly 54 is connected to the LCD screen 38 that is able to display alpha-numeric characters of the result 59.

In one example embodiment, the LCD screen 38 is in the same plane as the gauge face 24, which displays time remaining before the vessel 12 is depleted of gas, amount of pressure in the vessel 12, and the status of the remaining power in the battery 32. In the illustrated example embodiment, the power supply 32 comprises a dual power source of first and second power cells 32A, 32B, respectively such as batteries that supply power to the electrical system 23. In yet another example embodiment, the power cells 32A and 32B are coupled in parallel to the PCB 54 such that one power cell acts as a backup to the other should the power die or become low in either of the cells.

Figure 16:
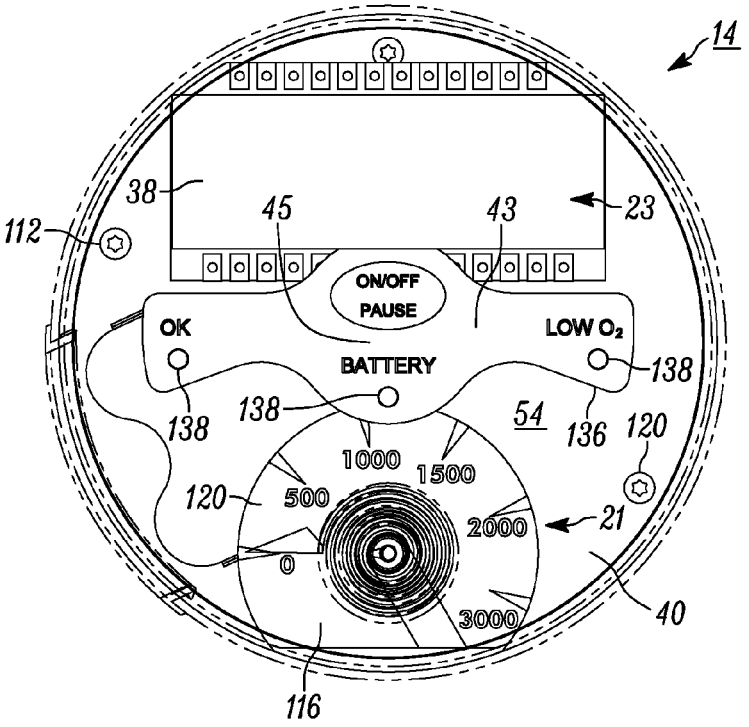
FIG. 16 is a front elevation of a pressure assembly constructed in accordance with another example embodiment of the present disclosure.
Figure 26:
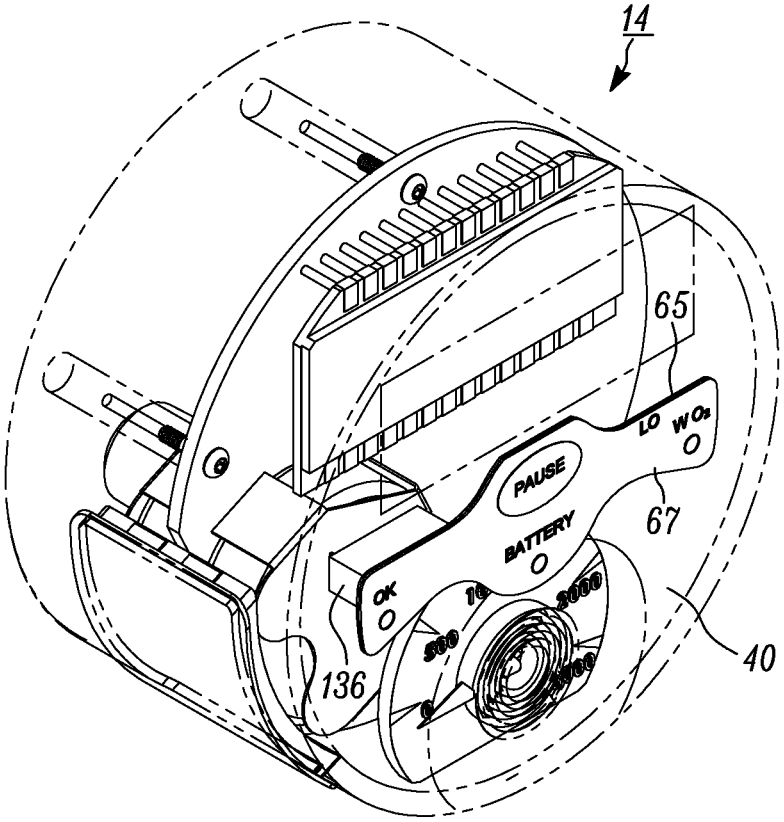
FIG. 26 is a perspective view of an information gauge apparatus constructed in accordance with another example embodiment of the present disclosure.

The PCB board 54 in one example embodiment provides a connection 136 to one end 65 of a membrane switch 43. Another end 67 of the membrane switch 43 is rigidly glued to the plastic lens 40, as illustrated in FIGS. 16 and 26. This membrane switch 43 has three LEDs 138 and a button 45 that can mute the voice chip 62 or power off the electronics and electrical system 23 by holding down a button or switch 45 for a long period of time (example 4 secs). The voice chip 62 provides audible information such as "Low Gas" when the pressure in the cylinder is inadequate for function. Through the membrane switch 43 the customer can view visual information indicating red (low pressure), Yellow (change battery), or Green (adequate pressure) lights through LEDs 138.

In the illustrated example embodiment, the membrane switch 43 is located on or near indicators 42 and provides a user interface for adjusting various settings on the gauge 14. In one example embodiment, the membrane switch 43 is in communication the PCB 54 and receives its power from the batteries 32. The membrane switch 43 includes in one example embodiment a switch 45 for pausing or halting the operation of the PCB 54 for putting the gauge 14 in sleep mode to conserve battery 32 life, various resets, and the like. In the illustrated example embodiment, the membrane 43 switch also includes a plurality of LEDs 47/138, providing status indicators (battery low, LOW $O_2$, and system OK) to a user that is viewable on the front of the gauge face 24. The location of the membrane switch 43 provides a robust construction that is protected by the gauge face 24.

The PCB assembly 54 is also programmed with logic that enables it to conserve battery life. By sensing if there is a reduction in pressure through the pressure sensor 48, the PCB assembly can determine if the unit 10 is being used. If there is no reduction in pressure, which implies the unit 10 is not being used, the PCB assembly 54 can activate a sleep mode 70. The sleep mode 70 will increase the duration between pulses, decrease the length of the LED pulse and also increase the frequency of sample from the pressure sensor 48, thus consuming less power. The PCB assembly 54 may also signal the LCD 38 to be blank in the sleep mode.

In one example embodiment, the gauge apparatus 14 provides an estimated time remaining that is dynamically updated to the face gauge 24 according to the chosen flow setting in a valve (not shown) located between the gauge 14 and vessel 12. In another example embodiment, the gauge 14 provides an audio visual warning, affording users of the unit 10 with confidence required to use the product as a multi-use system and warns the users when the gas level or pressure is low, thus improving efficiency and safety.

While yet another advantage of the gauge apparatus 14 is provided the mechanical system 21 acting as a analog or mechanical backup 72 formed by the novel input duct 16 that is rigidly connected to a custom but conventional direct drive gauge 116 with readings in case of failure to the pressure sensor 48. This is especially advantageous over solely digital designs that are susceptible to errors or inaccurate readings when near equipment producing magnetic fields, such as MRI equipment. The gauge apparatus 14 significantly reduces such errors due to this secondary analog backup system 72 of the present disclosure. Moreover, the mechanical backup system 72 improves the likelihood of approval of the FDA over fully digital systems because of the shortcomings discussed above.

In the illustrated example embodiment, the overall design and construction of the batteries 32, PCB 54, and sensor 48 are advantageously such to provide a very compact information gauge 14. In particular, the current construction is approximately one-inch thick (t) and two inches in diameter (D). Of course it should be appreciated that larger sizes of the gauge apparatus 14 are possible and within the spirit and scope of the present disclosure.

Yet another advantage of this example embodiment is the membrane switch 43, which enables the user to advantageously confirm the flow for fast accurate feedback. While a conventional gauge is capable of generating time to empty information relating to the vessel in which the gauge is being used, the conventional gauge does require a steady flowing state, which may take several minutes to occur if the flow rates are changed by a flow control (for example, from max to min) due to the inherent system dynamics. To avoid the long time delay experienced by users in conventional systems, users of the present gauge 14 have the option of selecting a flow setting by pressing the membrane switch 43, which toggles between various pre-set flow settings viewable in the LCD screen 38. The user therefore can select the matching flow setting administered to the patient that then results in immediate and accurate time to empty information. In this way, the user is able to verify if the time remaining is satisfactory before moving on to the next patient, which enhances safety through double-checking.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An information gauge apparatus for displaying information relating to diagnostics when said information gauge apparatus is coupled to a pressure vessel, the apparatus comprising:

a digital gauge having a digital display, printed circuit board, and pressure sensor, the digital display being coupled to and in communication with said printed circuit hoard that is further coupled to and in communication with said pressure sensor, the digital display illustrating pressure conditions relating a pressure vessel when in use;

a mechanical gauge providing a mechanically sensed pressure conditions relating to a pressure vessel when in use;

a casing for supporting said mechanical gauge and said digital gauge having a back plate and a from plate; and an input duct for coupling said digital gauge and said mechanical gauge to a pressure vessel during use, the input duct having a single orifice for coupling to a pressure vessel, the single orifice having a pathway that is divided between a first fluid communication channel for coupling to said mechanical gauge and a second fluid communication channel for coupling to said digital gauge.

2. The apparatus of claim 1, wherein said digital display further comprises an liquid crystal display (LCD) with an indicator for displaying the relative strength of a power supply located within said casing.

3. The apparatus of claim 1 wherein said casing is secured to the input duct, the casing further comprising bosses for rigidly locating said printed circuit board.

4. The apparatus of claim 1, wherein said printed circuit board further comprises a wireless transmitter for transmitting pressure information about a pressure vessel when in use.

5. The apparatus of claim 1, wherein said digital gauge further comprises a membrane switch for powering down the digital gauge, muting the voice alarm and selecting a preset flow.

6. The apparatus of claim 1, wherein said digital gauge further comprises an audible signal relating to the conditions sensed by said digital gauge pressure sensor.

7. The apparatus of claim 1, wherein said digital gauge further comprises an audible signal relating and a visual display, both relating to the pressure and remaining time before pressure reaches atmospheric pressure in a pressure vessel during use and said mechanical gauge providing a nonelectrical powered visual display as to the pressure in said pressure vessel during use.

8. The apparatus of claim 1, wherein said input duet comprises a flange for attaching said flange portion within and to said casing such that a portion of said input duct is positioned within said casing during use.

9. The apparatus of claim 1, wherein said mechanical gauge face that has a flat that enables assembly to said input duct without fasteners.

10. The apparatus of claim 5, wherein said membrane switch is rigidly connected to a plastic lens, the membrane switch having an input button.

11. An information gauge apparatus for providing both visual and audio readings of pressure within a pressure vessel, the information gauge apparatus comprising:

a digital display coupled to a printed circuit board in communication with a pressure sensor, the digital display illustrating indicia relating gas pressure levels provided by said pressure sensor to said printed circuit board during use;

an audible indicator coupled to said printed circuit board, the audible indicator providing an audible signal relating to gas pressure levels provided by said pressure sensor to said printed circuit board during use;

a mechanical sensor providing a mechanically sensed reading value to a visual indicia display on said information gauge apparatus relating to gas pressure levels during use; and an input duct for coupling said digital display and said mechanical sensor to a pressure vessel during use, the input duct having a single orifice for coupling to a pressure vessel, the single orifice having a pathway that is divided between a first fluid communication channel for coupling to said mechanical sensor and a second fluid communication channel for coupling to said digital display.

12. The apparatus of claim 11 wherein said input duct further comprises an electronic pressure sensor coupled to said duct in said second fluid communication channel and in communication with said digital display.

13. The apparatus of claim 12 further comprising a printed circuit board for coupling in communication said digital display with said electronic pressure sensor.

14. The apparatus of claim 11 wherein said first and second fluid communication channels comprise a tapped opening in fluid communication with said single orifice, the tapped openings for receiving a threaded end of said pressure sensor in said second fluid communication channel and a thread end of said mechanical sensor in said first fluid communication channel.

15. The apparatus of claim 14 wherein said mechanical sensor further comprises an analog gauge with a gauge face comprising indicia indicating the pressure of the pressure vessel during use, the indicia having at least one of florescent and luminescent paint.

16. A digital audio visual information gauge with a mechanical pressure indicating backup, said gauge comprising:

a casing that provides a housing for a mechanical system and an electrical system, the electrical system is capable of indicating time and pressure remaining in a cylinder valve assembly during use and the mechanical system being capable of indicate pressure remaining in the same cylinder valve during use;

an input duct that is rigidly connected to said casing, the input duct having a single orifice for connecting to a cylinder valve at a first end of said input duct and first and second fluid communication channels at a second end of said input duct, said first and second fluid communication channels being in communication with said single orifice, the first fluid communication channel for coupling to said mechanical system and said second communication channel for coupling to said electrical system.

17. The gauge of claim 16 further comprise a removable member that is serviceably connected to the case, said case further incorporating a face seal that is contact with the removable member, said case further comprising openings for the passing of sound waves from a sound chip of said electrical system.

18. The apparatus in claim 1 where the PCB has a dual power source that is rigidly attached to either side of the PCB.

19. The gauge of claim 16 wherein said mechanical system further comprises an analog gauge.

20. The gauge of claim 19 wherein said analog gauge further comprise a bordon tube for passage coupling to said input duct and said electrical system comprises a pressure sensor for coupling to said input duct.

21. An information gauge apparatus for coupling to a pressure vessel during use, the apparatus comprising:

a digital gauge having a digital display and pressure sensor, the digital display being coupled to and in communication with said pressure sensor, the digital display illustrating pressure conditions relating a pressure vessel when in use;

a mechanical gauge measuring and displaying a mechanically sensed pressure conditions relating to a pressure vessel when in use;

a casing for supporting said mechanical gauge and said digital gauge having a back plate and a front plate a lens that is located on the casing for viewing said mechanical gauge and said digital gauge; and an input duct for coupling said digital gauge and said mechanical gauge to a pressure vessel during use.

22. The apparatus in claim 1 further comprising a microprocessor for initiating a sleep mode condition of said apparatus for conserving power of a power supply located within said casing.

* * * * *